United States Patent [19]

Paulson

[11] Patent Number: 5,035,331

[45] Date of Patent: Jul. 30, 1991

[54] METHOD AND APPARATUS FOR REMOVING DUST AND DEBRIS FROM PARTICULATE PRODUCT

[76] Inventor: Jerome I. Paulson, 969 Edinburgh Dr., Lancaster, Pa. 17601

[21] Appl. No.: 393,642

[22] Filed: Aug. 14, 1989

[51] Int. Cl.[5] ..... B07B 7/04

[52] U.S. Cl. ..... 209/3; 15/10.51; 209/39; 209/133; 209/8

[58] Field of Search ..... 209/3, 8, 39, 136, 137, 209/138, 139.1, 133; 361/212, 215; 15/1.5 R

[56] References Cited

U.S. PATENT DOCUMENTS

| | | | |
|---|---|---|---|
| Re. 24,954 | 3/1961 | Church | 55/96 |
| 1,861,248 | 5/1932 | Stebbins | 209/139.1 |
| 3,441,131 | 4/1969 | Gebauer | 209/3 |
| 3,669,264 | 6/1972 | Bryant | 209/138 |
| 3,738,828 | 6/1973 | Inoue | 209/3 X |
| 4,299,693 | 11/1981 | Paulson | 209/3 |
| 4,363,070 | 12/1982 | Kisler | 361/212 |
| 4,379,748 | 4/1983 | Hoogendoorn | 209/138 X |
| 4,631,124 | 12/1986 | Paulson | 209/3 |
| 4,668,381 | 5/1987 | Julius | 209/39 |
| 4,835,808 | 6/1989 | Hahne et al. | 15/1.5 R |

*Primary Examiner*—Donald T. Hajec
*Attorney, Agent, or Firm*—Russell J. Egan

[57] ABSTRACT

The impurity laden particulate material to be cleaned by a gravity feed deduster is passed through a magnetic field of varying intensity to neutralize the static charge causing the impurities to adhere to the primary product. The material is then subjected to air flows to separate the neutralized debris from the primary product. The air flows can be of high velocity and can be either pressurized air or vacuum induced. The cleaned product is collected and the contaminated air is treated to recover the debris therefrom.

20 Claims, 4 Drawing Sheets

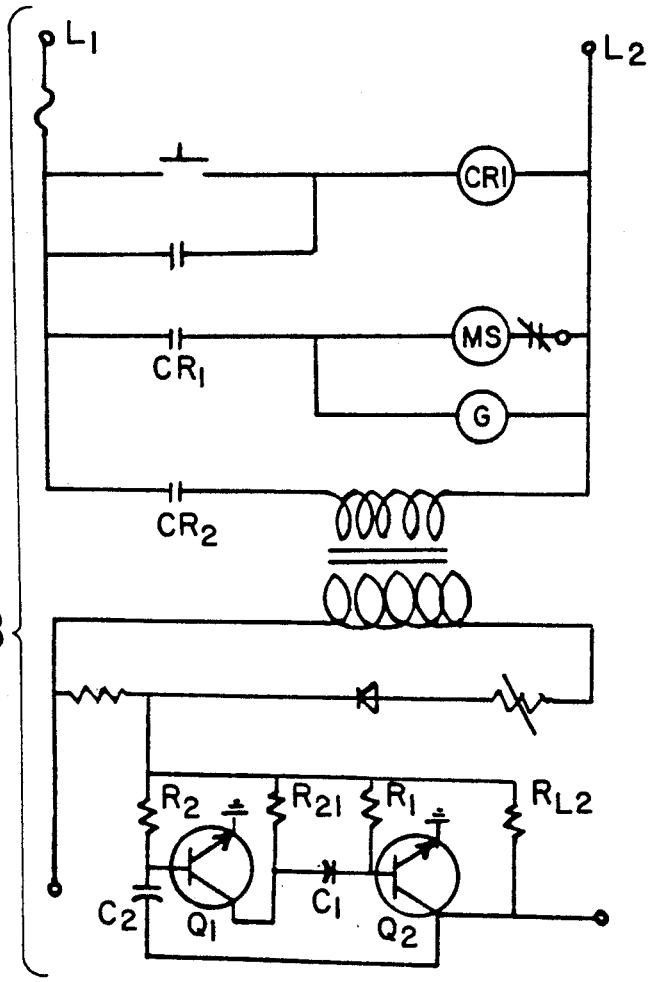
FIG. 8
FIG. 9
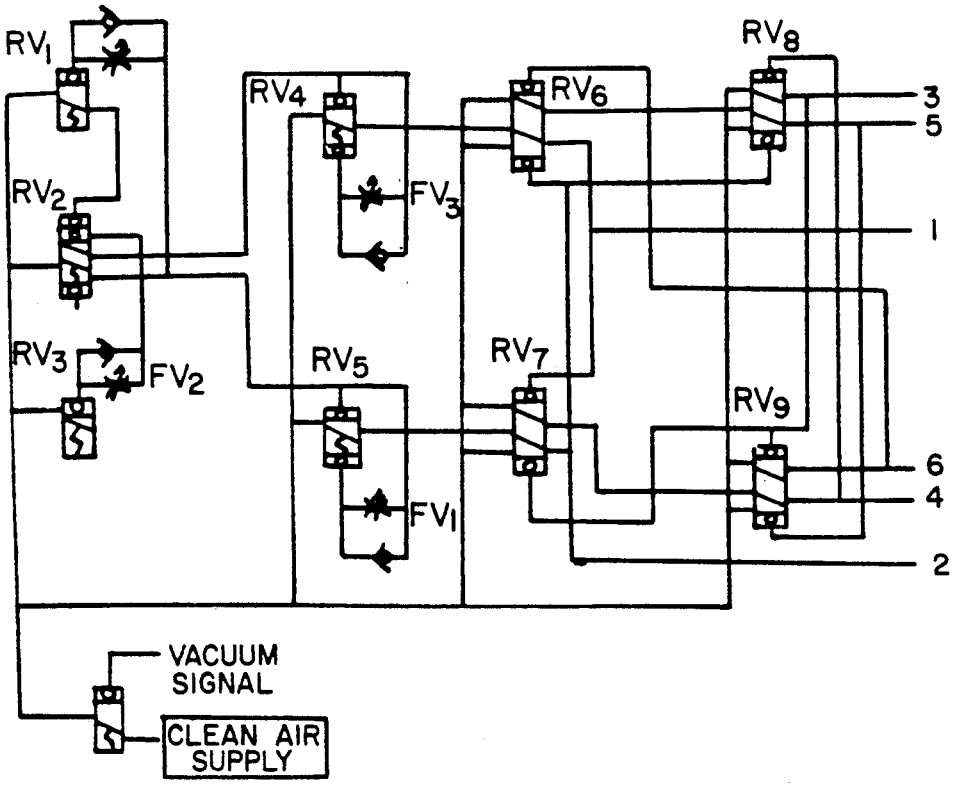

METHOD AND APPARATUS FOR REMOVING DUST AND DEBRIS FROM PARTICULATE PRODUCT

BACKGROUND OF THE INVENTION

1. The Field of the Invention

The present invention relates to deduster apparatus and in particular represents an improvement over my previous inventions described in U.S. Pat. Nos. 4,299,693 and 4,631,124.

2. The Prior Art

It is well known that, in the field of transporting particulate product, commonly powders, granules, and the like generically referred to as powders, it is important to keep the product as free as possible of contaminants. Contaminants would include both foreign material as well as broken particles or streamers of the product being transported. In either case, using plastics as an example, such foreign material would have a detrimental effect on the finished product. Specifically, foreign material different in composition from the primary material, such as dust, and non uniform material of the primary product, such as streamers, would not necessarily have the same melting temperatures as the primary product and would cause flaws when the plastics material is melted and molded.

There have been many attempts to come up with means for transporting particulate product without causing breakage of the product and for separating out foreign matter of all types so that a substantially uniform clean product is delivered.

In my previous patents, mentioned above, I described apparatus which used neutralization of static charges together with counter flow of air currents to separate lighter dust particles from the main product being transported. Subsequently I have learned that there is more to separating dust, streamers, and the like than just passing the material through a magnetic field. Different materials require different handling because the charges which they carry may vary depending upon the makeup of the primary product. Thus it is desirable to not only pass the material through a magnetic field, but to vary that magnetic field to achieve a magnetic resonance which will effectively neutralize the charge of the dust and debris adhering to the primary particulate product.

SUMMARY OF THE INVENTION

The present invention constitutes an improvement over my previous inventions by providing a deduster in which gravity flow is utilized to promote the smooth movement of particulate product through a cleaning zone. Flow control means are utilized to regulate the amount of product passing through the apparatus at any one time. The flow path passes through a magnetic field which serves to disrupt the static charge attraction of dust, debris and the like adhering to the primary particulate product thereby allowing this unwanted material to be separated and removed from the product flow path. The magnetic field is varied in strength and frequency (varying the level and intensity of the flux field) in order to more effectively cause separation of the foreign materials from the primary particulate product. Primary separation is achieved by airflow through the product to both remove the unwanted material from the flow path and to accelerate the primary product along that path. A venturi zone creates a high relative velocity counter air flow to more effectively promote separation of the foreign material from the primary product. Secondary cleaning and magnetic fields can also be provided. The discharge air is treated to trap the removed dust and debris preventing it from returning into the flow path. The subject apparatus preferably has a slight negative internal pressure to assure collection of the separated dust and debris. The dust collection is in a filter system which includes periodic backflow of clean air through the filter to both extend the life of the filter and to assure long term efficient operation.

BRIEF DESCRIPTION OF THE DRAWINGS

The present invention will now be described by way of example with reference to the accompanying drawings in which:

FIG. 8 is an electrical schematic of a representative circuit for controlling the flux field generators; and FIG. 9 is a schematic of the pneumatic back flush filter cartridge cleaning system.

DETAILED DESCRIPTION OF THE PREFERRED EMBODIMENT

Figure 2:
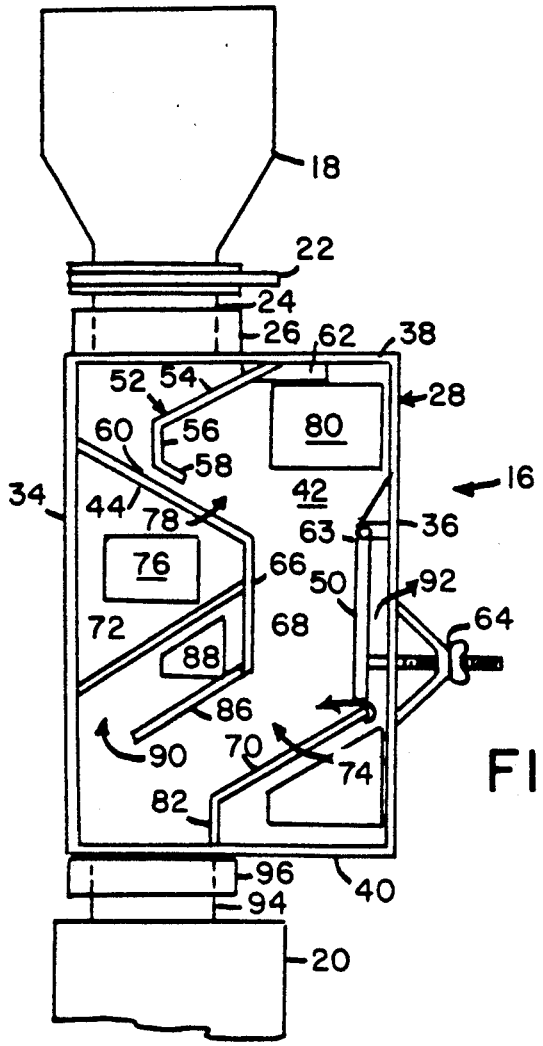
FIG. 2 is a side elevation of the deduster according to the present invention.
Figure 1:
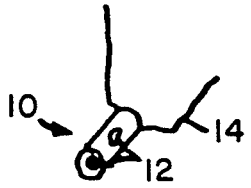
FIG. 1 is a schematic representation of a piece of primary product prior to cleaning by the subject apparatus.

A representative piece of product to be cleaned by the present invention is schematically illustrated in FIG. 1. In this instance the product 10 is a generally cylindrical piece of plastics material having dust 12 and streamers 14 adhering thereto. Either the dust or the streamers or both could be of the same material as the primary product 10 or they could be completely dissimilar contaminants. It is important, and therefor the primary object of the present invention, to separate dust, streamers and the like to pass only clean primary product through the exit port of the subject apparatus.

Figure 5:
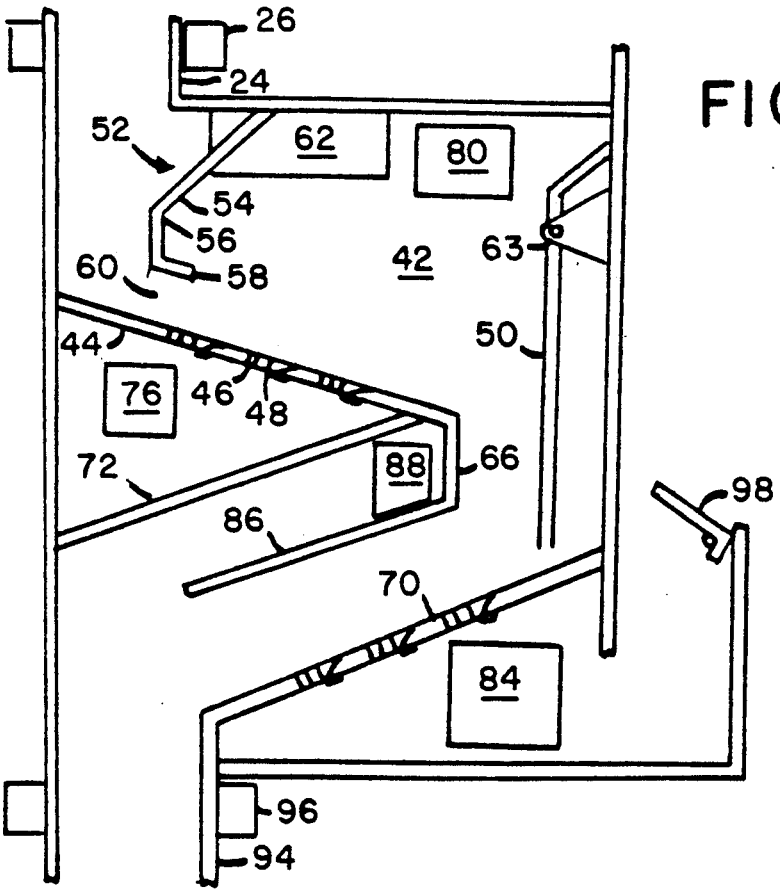
FIG. 5 is a detail of the second flow control means.

The subject deduster 16 is mounted in a vertical portion of a fluent material handling system (not shown) between a discharge hopper 18 and a collector 20. The discharge hopper 18 includes a control gate 22 of conventional design. An input conduit 24 joins the hopper 18 to the deduster 16 and is surrounded by a first flux field generator 26. The subject deduster 16 has a primary housing 28 with front and rear panels 30,32 (FIG. 3), joined by end panels 34,36, and top and bottom panels 38,40 to define a central chamber 42 containing a generally vertical tortuous path for the product 10. First airwash deck 44 is mounted between the front and rear panels 30,32 opposite the input conduit 24 and is inclined downwardly from end panel 34 at a minimum angle of 30 from the horizontal. The air wash deck 44 has a patterned array of holes 46 and slots 48. The holes 46 serve to create jets of air, which are directed substantially vertically through the product layer, causing the entrained dust 12 and streamers 14 to be driven upward away from the product 10. The slots 46 provide a ribbon or sheet of air which accelerates the product 10 forward along the product path toward the deflector plate 50. This increased velocity of the product permits use of higher counter current air velocity resulting in improved cleaning efficiency. First inlet deflector means 52 is mounted spaced above and inclined opposite to the first airwash deck 44 and is shown formed by three plates 54,56,58 defining a material passage 60 between the deflector means 52 and airwash deck 44. Means 62, such as racks and pinions or gears (not shown) are used to move the deflector means plates horizontally with respect to end panel 34 and vertically with respect to airwash deck 44. This allows for adjusting the size of the opening of passage 60 to control both the volume of material admitted to the airflow deck and the thickness of that material flow. The deflector plate 50 is spaced opposite the lower or discharge end of airwash deck 44. The upper end of plate 50 is mounted on end panel 36 by pivot means 63. Control means 64 at the opposite lower end of the deflector plate sets the angle between plate 50 and vertical panel 66 fixed to the discharge or lower end of deck 44. Plate 50 and panel 66 form a vertical venturi passage or zone 68. Second airwash deck 70 is fixed between the front and rear panels 30,32 with an incline opposite to that of the first airwash deck 44. Again the incline is at a minimum angle of 30°. A fixed panel 72 is spaced above and generally parallel to the second airwash deck 70 and forms a chamber 74 beneath the first airwash deck 44. Pressurized air is introduced into chamber 74 through inlet port 76 from a known source (not shown) to flow out through first airwash deck 44 (arrows 78). An exit port 80 is provided for this air flow. Bottom wall 40 of the deduster 16, along with front and rear panels 30,32 and end wall 36, form a second pressure chamber 82 located beneath the second airwash deck 70. Pressurized air is admitted to chamber 82 through port 84. A second fixed panel 86 is spaced generally parallel to and between panel 72 and second air wash deck 70 and fixed to the lower end of panel 66. Panels 72 and 86 define an air flow path for air passing through the second airwash deck 70 to an exit port 88 (arrows 90). Air will also flow around the upper end of second air wash deck 70 and lower end of deflector plate 50 and some will exit through a bleed off 98 (see FIG. 5) along the path of arrows 92 to assure a slight negative pressure within chamber 42. Outlet conduit 94 is in the bottom wall 40 and is surrounded by a second flux field generator 96.

The electrical schematic for the present invention is shown in FIG. 8. It is relatively straight forward in that power is provided for the blower motor to supply air and a variable DC power supply circuit is provided for the flux generators with the latter including a frequency control circuit which is variable by adjusting either the resistance or capacitance so that the flux field varies in level and intensity.

The operation of the subject deduster 16 is as follows: a volume of particulate material to be cleaned, said volume containing both the primary product 10 together with debris 12 and streamers 14 adhered thereto and included therewith, is introduced to the deduster 16 from hopper 18 by opening gate 22. The volume of material passes through the first flux field generated by coil 26 to effect an initial disruption of the static charge attraction causing the debris 12,14 to adhere to the primary product 10. Material flow control is important in order to cause particles to disperse in such a way that air can flow freely through the product stream lifting contaminants upward away from the product. The flow of material through the deduster is controlled by the gap 60 between the deflector means 52 and first airwash deck 44. Too thick of a layer of material may prevent air from passing through the material to separate out the debris while too thin a layer will not be an efficient usage of the air flow. Pressurized air flows through the holes 46 in first airwash deck 44 to separate this debris 12,14, which is smaller and lighter than the primary product 10. The air flow through slots 48 accelerates the partially cleaned product toward deflector plate 50. This partially cleaned product 10 then falls through the passage 68 against the higher velocity venturi counter air flow which will further clean it by separating the unwanted material from the primary product. The product falls onto the second airwash deck 70 for a further separation of debris from the primary product in the same manner as just discussed.

The first airwash deck and flux field separate small particles of 100 microns and less from the primary product. The venturi chamber, when adjusted correctly, will remove larger contaminants thereby providing two stage separation of contaminants as large as 1/16 of an inch. The primary product is then passed across the second airwash deck 70 with residue debris being separated at this time. Finally the cleaned product is passed through a second flux field generated by coil 96 to insure that no static charges will remain to attract further debris to the cleaned primary product. Both flux fields generated by coils 26 and 96 are shaped to provide some overlap, thereby bathing the entire apparatus in the disruptive field. Larger machines may also have a dust pick up at the secondary airwash deck.

The present invention has recognized the reason why debris adheres to the primary product and how this can be treated for full separation. When particles are moved by any mechanical activity, a portion of the mechanical energy is converted or transformed into an electrostatic charge known as "Triboelectrification". This charge is lost to air or other mediums by the ratio of the particle's mass to surface area. As the surface area is a function of it's "square", and the mass is a function of it's "cube", large particles will lose their charge over longer time periods. Small particles will rapidly lose their charge resulting in an opposing charge balance. Particles with opposing charges are attracted to each other and form a "magnetic unit". All magnetic units will exhibit the same characteristics, such as magnetic flux fields. This field can be observed with simple instruments, such as the magnetic needle of a compass. The strength of the field is a function of it's charge, namely the differential between positive and negative charges. This magnetic flux field is geometric in that the lines of force, which bind two particles of opposing charge, are linear through the centers of mass. The predictability of this mechanism is best demonstrated by the navigator's reliance upon a compass to provide directional information when traveling the surface of the earth. The linearity of the force field can be disrupted by the presence of a third field. If the field consists of a two body system, the disruption of the binding field will cause the two bodies to separate when some mechanical force is applied. The mechanical force will cause separation where a difference of size and mass of the bodies is present. As previously stated, small, light particles which have lost their "Triboelectrification" charge, have a high surface to mass ratio, and will be easily lifted when subjected to a jet of air. The heavier bodies will fall through the same air stream that lifts lighter bodies. The characteristics of the disrupting field must match the binding field in order to break the linear bond between particles. The binding field will vary from particle system to particle system due to the differences in charge strength. Therefore it is necessary to produce a variable disruption field. This is accomplished by converting an alternating electrical current at voltages from 0 to the level which provides full disruption. The magnetic disruption field must be alternately turned off and turned on in order to produce a range of field strengths which match the many different "two body fields". The field frequency may be varied so that many "disruption matches" will occur while the "two body" systems are under the mechanical separation influence.

The present invention also includes an inlet deflector adjacent the product inlet to provide focussing of incoming product onto the first airwash deck. By controlling the depth of the product while it is influenced by the disruption magnetic field, the wash air will provide a much higher separation efficiency. In addition, the air stream through the airwash deck will lift streamers up above the product stream. The deflector plate prevents flooding of the first airwash deck with too much product which would prevent air flow of sufficient force to separate debris and thereby allow unseparated product to pass through this stage of the subject deduster. The deflector means should be adjusted for optimized product flow.

The pressurized air flow system of the present invention is preferably a closed loop system with the same air volume being drawn in by the blower that it discharges. By allowing a controlled portion of the wash air to escape, the deduster will become negative causing makeup air to be drawn into the deduster flowing behind the venturi deflector and up it's face. This will prevent streamers from passing through this zone. An optional hood may be added at a by-pass damper (not shown) thereby providing a complete environmental seal should hazardous products or inert gases be passed through the deduster.

Dust and streamer collection is accomplished by incorporating the combination of a cyclonic dust separation and counter flow cartridge filter. One such known system is the mikro-pulsaire dust collector described in U.S. Pat. No. Re 24,954, the disclosure of which is incorporated herein by reference.

Figure 3:
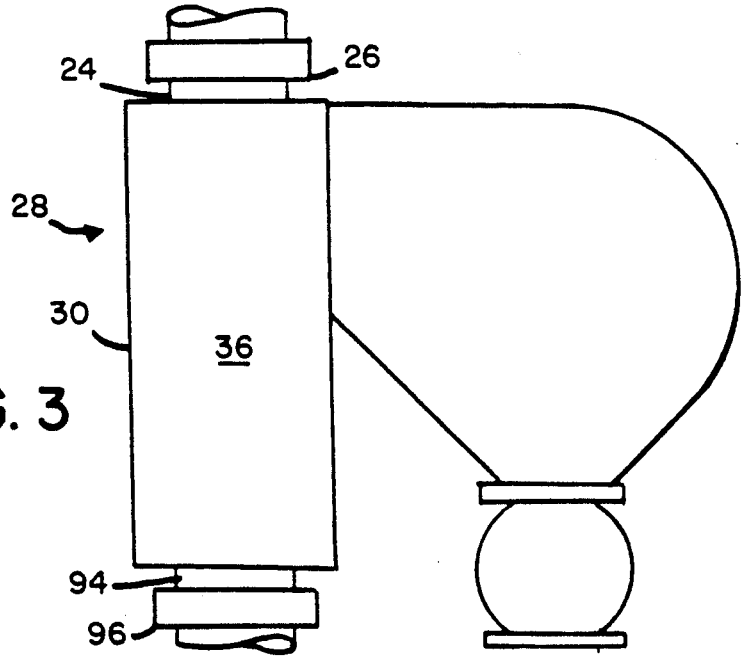
FIG. 3 is an end view of the subject deduster.
Figure 4:
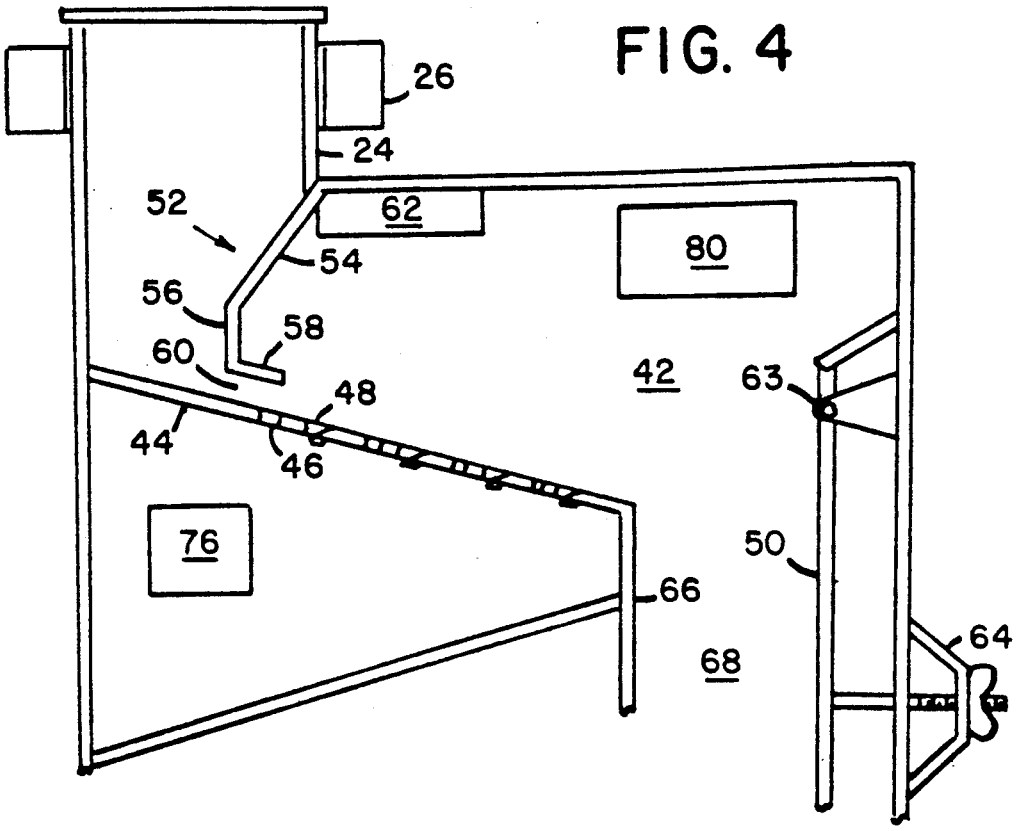
FIG. 4 is a detail of the first flow control means.
Figure 7:
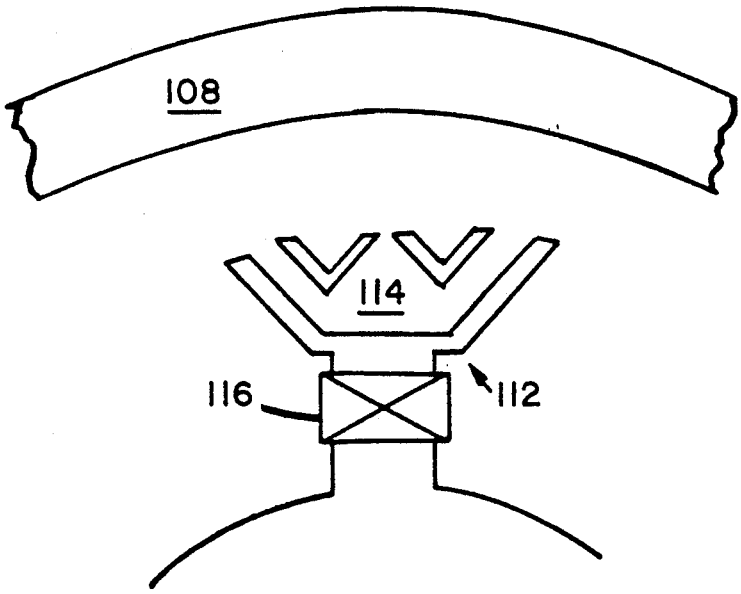
FIG. 7 is an enlarged detail, partially in section of the filter portion.
Figure 6:
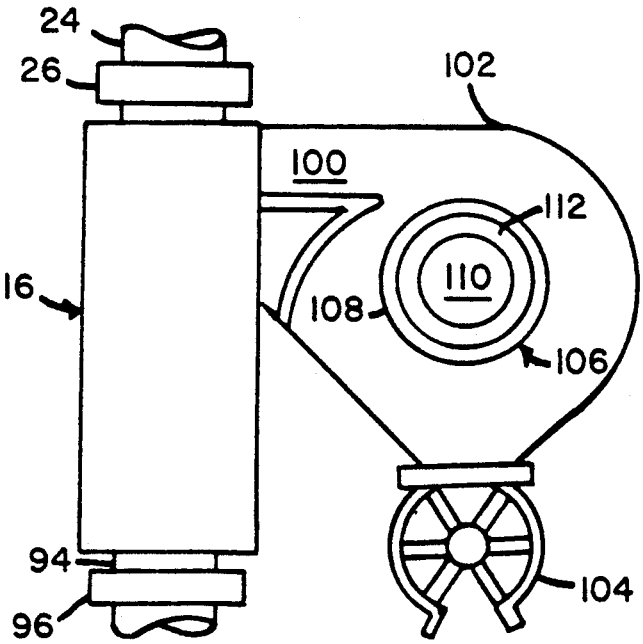
FIG. 6 is an end elevation of the filter portion of the present invention.

The duster collector portion of the present invention is shown in FIGS. 3, 6 and 7. The collection chamber 100 is connected to exit ports 80 and 88 and extends generally normal to the flow path through the deduster. The chamber 100 has a curving wall 102 which directs the air along an arcuate path to a rotary airlock 104. A cylindrical filter assembly 106 is mounted substantially in the center of the chamber with the axis of the filter extending axially of the air flow path. The filter assembly includes a cylindrical cartridge 108 of known dust collecting material. The cartridge 108 is mounted about a central cleaning unit 110 having a plurality of back flush units 112 each having at least one profiled jet 114 directed toward and closely adjacent the filter cartridge 108. Each back flush unit 112 is connected to a source of clean pressurized air (not shown) through a valve 116. The control means for these valves is shown in FIG. 9. The control circuit consists of a clean air supply (not shown) connected to the circuit by signal valve SV1. A plurality of relay valves RV1-9 are used to control a number of slow control valves FV1-9 to sequentially or simultaneously send clean pressurized air back through the cartridge to clean it.

Contaminant debris 12,14 that has been separated from the product 10 is drawn by vacuum through an internal duct plenum connected to openings 80,88 at the back of the deduster. Contaminate laden air enters at high velocity and impinges on the cyclonic wall 102. This agglomerate stream follows the curve of the wall by centrifugal force and encounters the rotary airlock 104 where the debris 12,14 will be discharged into a dust container (not shown) for reuse or disposal. The air (now free of the heavier contaminants) continues to flow around the filter cartridge 108 through which it is drawn thereby removing the last bit of dust. The cleaned air can then be recycled through the system.

Inside the cartridge 108 are radial rows of back flush units 112 through which clean air streams pass and are drawn into the blower fan inlet opening. The back flush air purge units are mounted radially with jets 114 facing the inside of the dust cartridge 108. Each unit 112 has valve means 116 which are periodically opened to pass a quantity of pressurized air. This air rapidly pressurizes the inside of the tube and causes high velocity jets to emit from long slots forcing a localized reverse flow of air to occur on a portion of the cartridge filter 108. The reverse flush will force small dust particles impinged on the outside to be dislodged and re-entrained in the cyclonic air stream.

Continuous cleaning of the dust cartridge provides a long term uninterrupted dust removal. Back flush velocities will exceed dirty air velocities by a minimum of 2:1. This continuous cleaning of the cartridge filter provides several benefits including routine maintenance of the cartridges is reduced while it's life is extended, space is conserved, and a smaller volume of compressed air is required.

The forgoing description has referred to only use of pressurized air. The present invention could employ a vacuum system to create the necessary air flows.

The present invention may be subject to many variations and alternatives without departing from the spirit or essential characteristics thereof. The present embodiment is therefor to be considered in all respects as illustrative and not restrictive of the scope of the invention.

I claim:

1. A dedusting device for separating dust and similar unwanted debris adhering to particular product and entrained therewith, said dedusting device having at least one chamber defining a substantially vertical feed path through which said particulate product free falls by gravity, at least one coil surrounding an entry end of said chambers and adapted to generate a magnetic field for neutralizing the static electricity charge causing the debris to adhere to the primary product and at least one cleaning chamber having means for subjecting said product to an air flow to cause the neutralized debris to separate from the heavier product, characterized by means for varying the level and intensity of said magnetic field whereby the static charge of the debris is more effectively neutralized.

2. A dedusting device according to claim 1 wherein said cleaning chamber further comprises at least one airwash deck which passes air substantially normally through the product to drive off the unwanted debris, and means to collect said separated debris to prevent it from becoming re-entrained with said product.

3. A dedusting device according to claim 1 wherein said cleaning chamber includes at least one airwash deck which subjects the product to a first air flow separating the debris from the product and a secondary air flow which accelerates the product through the chamber.

4. A dedusting device according to claim 3 further comprising a venturi zone which receives the accelerated product and subjects it to a high velocity counter air flow whereby residual debris is separated from the product.

5. A dedusting device according to claim 1 wherein said air flow is pressurized clean air.

6. A dedusting device according to claim 1 further comprising dust collecting means whereby the debris separated from the product is trapped and prevented from becoming reentrained with the primary product.

7. An apparatus for effectively removing unwanted debris adhering to particulate product while said product is being conveyed through a transport system, said apparatus comprising:

a closed housing in a portion of said transport system between a product inlet means and a cleaned product collector, said housing having an inlet and an outlet and defining a feed path for said product, at least part of said path including product free fall under the influence of gravity;

at least one flux field generating coil surrounding said free fall part of said path and subjecting product passing therethrough to a magnetic field of varying level and intensity which field neutralizes charges of debris passing therethrough;

at least one airwash deck receiving said product and subjecting it to a transverse flow of clean air of sufficient magnitude to separate to magnetically neutralized debris from the product; and filter means connected to receive debris laden air coming from said airwash deck and collect the debris therefrom.

8. An apparatus according to claim 7 wherein said transport system is gravity actuated, said inlet means is a hopper, and said feed path is generally vertical.

9. An apparatus according to claim 7 further comprising a flux field generating coil at the outlet of said housing.

10. An apparatus according to claim 9 wherein the flux fields of said flux field generating coils overlap.

11. An apparatus according to claim 7 further comprising control means for controlling said flux field generating coils to product a varying level and intensity of the flux field generated.

12. An apparatus according to claim 11 wherein said control means is resistive.

13. An apparatus according to claim 11 wherein said control means is capacitive.

14. An apparatus according to claim 7 wherein said airwash deck has a plurality of holes and slots therein, said holes directing air flow through the product passing over said deck to drive the debris therefrom and said slots forming an air flow sheet which is directed along the feed path and which accelerates the product along said path.

15. An apparatus according to claim 7 further comprising a venturi zone at the end of said airwash deck, said zone receiving product from said airwash deck and subjecting it to a high velocity counter flow of air whereby heavier particles of debris are separated from the product.

16. An apparatus according to claim 7 further comprising at least a second airwash deck positioned to form a tortuous feed path for said product.

17. An apparatus according to claim 7 wherein said filter means further comprising chamber means to receive the contaminated air from said chamber and to reduce the velocity of said contaminated air causing the debris to drop out of the air flow, and filter cartridge means through which said air flows to complete the removal of debris therefrom.

18. An apparatus according to claim 17 further comprising means for subjecting said filter to back flow of air whereby said filter is periodically cleaned.

19. An apparatus according to claim 7 further comprising means to control the volume and thickness of the product entering said feed path.

20. A method for cleaning particulate product to separate debris therefrom comprising the steps of:

passing debris contaminated product in free fall through a flux field of varying intensity to neutralize the static electrical charge causing the debris too adhere to said product;

subjecting the neutralized product to at least one air flow to drive off the neutralized debris which is lighter than the primary product; and separately collecting the cleaned product and debris.

* * * * *